US006197370B1

(12) United States Patent
Rao et al.

(10) Patent No.: US 6,197,370 B1
(45) Date of Patent: Mar. 6, 2001

(54) COATING CYLINDER BORES WITH ULTRA THIN SOLID LUBRICANT PHASE

(75) Inventors: V. Durga Nageswar Rao, Bloomfield Twp.; Edward Andrew Soltis, Dearborn Heights; Harry Arthur Cikanek; Michael Schroder, both of Northville, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/346,150

(22) Filed: Jul. 9, 1999

(51) Int. Cl.[7] ..... B05D 7/22

(52) U.S. Cl. ..... 427/236; 427/239; 427/327; 427/421

(58) Field of Search ..... 427/236, 239, 427/327, 421; 118/306, 317, 323

(56) References Cited

U.S. PATENT DOCUMENTS 4,063,686 * 12/1977 Willis .
4,335,677 * 6/1982 Nagata et al. .
5,271,967 * 12/1993 Kramer et al. .
5,303,141 4/1994 Batchelder et al. .
5,358,753 10/1994 Rao et al. .
5,363,821 * 11/1994 Rao et al. .
5,482,637 1/1996 Rao et al. .

* cited by examiner

*Primary Examiner*—Fred J. Parker

(57) ABSTRACT

An apparatus to coat cylinder bores with precise thickness and adhesion having a nozzle for effecting a hollow conical spray pattern of an emulsion about an axis, a highly pressurized supply of emulsion to the nozzle, the emulsion containing solid lubricant in fluid suspension and means for controllably moving the nozzle within the cylinder bore to deposit a coating of the emulsion in the thickness range of 8–13 microns. A method for coating cylinder bores includes preparing the cylinder bore surface to expose fresh metal free of contamination, generating a hollow conical spray consisting of fine mist droplets of a solid lubricant emulsion (the conical spray having an effective base with a diameter greater than the diameter of the cylinder bore), and moving the apex of the conical spray along the axis of the bore at a uniform speed to deposit a coating of the emulsion on the interior of such cylinder bore in a thickness no greater than 20 microns.

6 Claims, 3 Drawing Sheets

COATING CYLINDER BORES WITH ULTRA THIN SOLID LUBRICANT PHASE

TECHNICAL FIELD

This invention relates to the technology of coating cylinder bores and, more particularly, to coatings deposited in an ultra thin and uniform thickness while containing solid lubricant particles.

DISCUSSION OF THE PRIOR ART

Early bore coatings for automotive aluminum cylinder bores were created by use of an anodizing process (electro/electroless deposition) which resulted in a high nickel alloy, Nikasil; disadvantages of this process were higher friction, increased requirements for plant space and processing time, and higher investment and processing costs. Subsequent attempts to reduce friction while improving reliability involved use of cast iron liners or the application of cylinder bore coatings using standard spray paint equipment. When spray painting, a nozzle for the spray equipment was held at the mouth of the bore and the nozzle was articulated to achieve a 360° rotated deposition coating. Unfortunately, such equipment was cumbersome to manipulate and resulted in the coating being unusually thick (see U.S. Pat. Nos. 5,482,637 and 5,363,821).

Coating of aluminum cylinder bores have been recently carried out with thermal spray techniques, such as plasma arc and wire arc, to achieve a highly adherent coating that can withstand the demanding high temperature environment of an engine cylinder. The equipment to carry out such coating technique is complex and requires considerable expertise in controlling the coating because it is carried out in an enclosed, or hidden, environment (see U.S. Pat. No. 5,358,753). This technology is in its earliest stages of implementation dedicated to high volume production and is not suitable for small shop applications, such as engine repair or racing shops involving a small number of engines.

SUMMARY OF THE INVENTION

It is an object of this invention to provide an improved method of coating cylinder bores by (i) depositing the solid lubricant phase from a fine mist of emulsion droplets formed in a hollow conical spray pattern, and (ii) controlling the movement of the spray pattern across the bore interior to achieve extremely accurate coating thickness without the need for subsequent finish honing.

It is also an object of this invention that equipment needed to carry out such method be relatively inexpensive, capable of very high production rates and require low to moderate floor space, and thus make the method implementable in existing shops or plants.

The method of this invention that achieves such object comprises the steps of (a) preparing the cylinder bore surface to expose fresh metal free of contamination, (b) generating a hollow conical spray consisting of fine mist droplets of a solid lubricant emulsion, the conical spray having an effective base with a diameter greater than the diameter of the cylinder bore and (c) moving the apex of the conical spray along the axis of the bore at a uniform speed to deposit a coating of the emulsion on the interior of the cylinder bore in a thickness no greater than 20 microns.

The invention in another aspect is an apparatus to coat cylinder bores with precise thickness and adhesion, comprising: (a) a nozzle for effecting a hollow conical spray pattern of an emulsion about an axis, (b) a highly pressurized supply of emulsion to the nozzle, the emulsion containing solid lubricant in fluid suspension and (c) means for controllably moving the nozzle within the cylinder bore to deposit a uniform coating of the emulsion preferably in the thickness range of 5–15 microns with flexibility for greater thicknesses up to 30 microns should it be desired.

DETAILED DESCRIPTION AND BEST MODE

Figure 2:
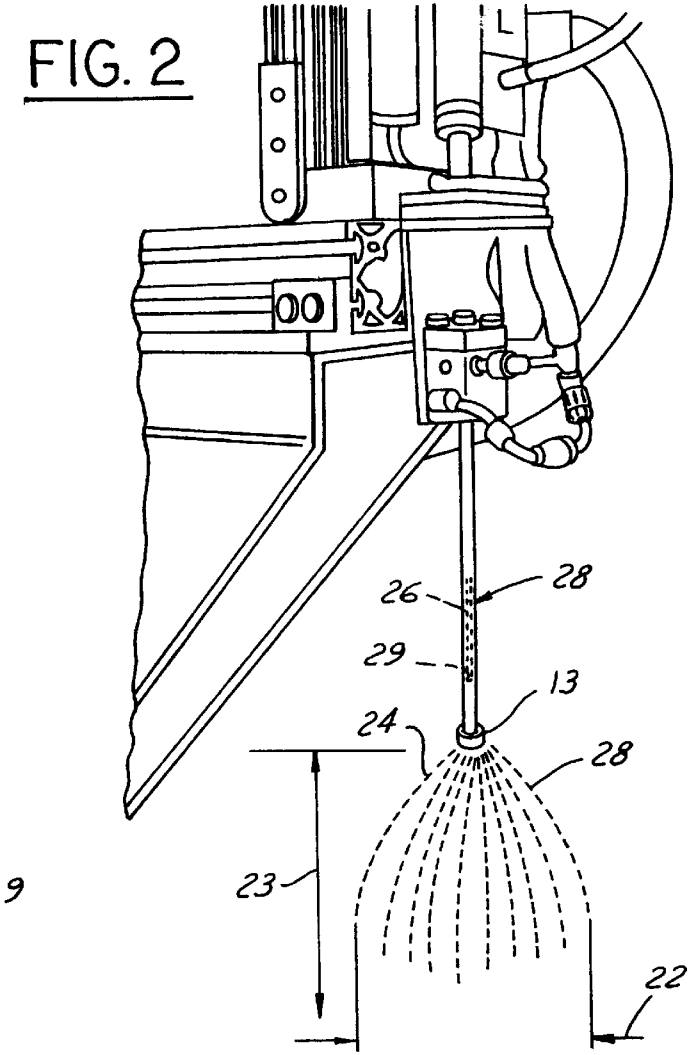
FIG. 2 is an enlarged perspective view of the nozzle used to spray an emulsion for carrying out coating according to this invention.

The emulsion preferably consists of a thermoset polymer base containing at least 15% by volume (6% by weight) of solid film lubricants consisting of $MoS_2$, BN and graphite. Although other emulsions containing solid lubricants can be used, it is of great importance that they deposit a film from the emulsion that is uniform in chemical composition (free from lumps) and exhibits excellent friction and wear characteristics in both dry and conventional oil lubricated conditions on diverse materials, such as hardened steel, cast iron surfaces, aluminum alloys, or silicon nitride.

Mechanical friction significantly affects internal combustion engine fuel economy. Piston-to-bore clearance, variations induced by cylinder bore distortions (caused by variations in engine speed and loading under normal engine operating cycles, cooling gradients, as well as machining and fabrication induced distortions, all may combine to cause serious distortions leading to cylinder runout and concentricity during engine operation. These distortions seriously increase friction leading to bore wear, as well as blowby (resulting in excessive fuel consumption) and excessive engine oil consumption. Most of the severe bore wear occurs at the top ring reversal zone of a cylinder bore due to the high ring-bore contact pressure, combined with very low (near zero) piston speeds producing boundary friction conditions. To alleviate this, state of the art production techniques, finish hone the cast iron bores to produce a special oil-retaining surface texture called plateau hone finish. This texture, with retained oil, facilitates dissipation of frictional heat and prevents excessive bore wear; however, with accumulating engine operating time, the bore wear at the top of the ring reversal zone continues to occur and ultimately destroys the texture. As a consequence, bore wear and oil consumption are aggravated and engine life is limited.

The emulsions used with the present invention incorporate low friction solid film lubricants that promote rapid oil film formation onto the coating and allow the oil film to tenaciously cling thereto to reduce friction and wear significantly. The solid film lubricant also responds to frictional heat to reduce the friction coefficient (an inherent characteristic of the solid film lubricant composition) and allows its surface asperities to be easily evened-out resulting in a very smooth finish approaching 0.01–0.02 micro meters $R_a$. The combination of the tenacious oil film (of approximately 0.5 micro meters thickness) and the extremely smooth surface finish, develops hydrodynamic lubrication which occurs when the oil film is at least 6 times the height of the asperities. As a result of such friction phenomena furthering to the hydrodynamic lubrication regime, incorporation of the solid film lubricant allows a much smoother surface finish without loss of engine life because of its oil holding or retaining characteristics. Therefore, it is readily apparent that anything that promotes hydrodynamic lubrication reduces engine friction. One of the important characteristics of the thermoset polymer base, containing molydisulphide, boron nitride and graphite, is that it is effective in maintaining the hydrodynamic lubrication regime, as well as being self- healing. Thus, if two rubbing surfaces, at least one of which is coated with such solid lubricant, are placed in intimate contact, asperities of such surfaces will protrude in a random fashion above the coated surface planes, and the tips of such asperities will come into rubbing contact. A certain amount of heat is thereby generated due to the intimate rubbing contact of these asperity tips. These asperity tips will wear down locally and become somewhat smoother. The thermal energy created by this local friction heats up the local surrounding area, which is the coated solid film lubricant, and it in turn becomes heated and tends to flow locally and eventually, the worn down exposed metal surfaces become coated with a few molecular layers of the solid film material. Local friction is then reduced, since it only takes a few molecular layers of the solid film lubricant to exhibit a reduced friction coefficient. Moreover, the solid film lubricant shears under the contact forces (being the weaker material) to reduce friction in the hydrodynamic regime. The preferred solid film lubricant has an affinity for oil to cling tenaciously to such lubricant. As indicated earlier, incorporation of the solid film lubricant allows a much smoother surface finish without loss of engine life because of its oil holding or retaining characteristics; that which promotes hydrodynamic lubrication reduces engine friction. This is a very important characteristic which additionally promotes cooling and reduces friction.

Figure 1:
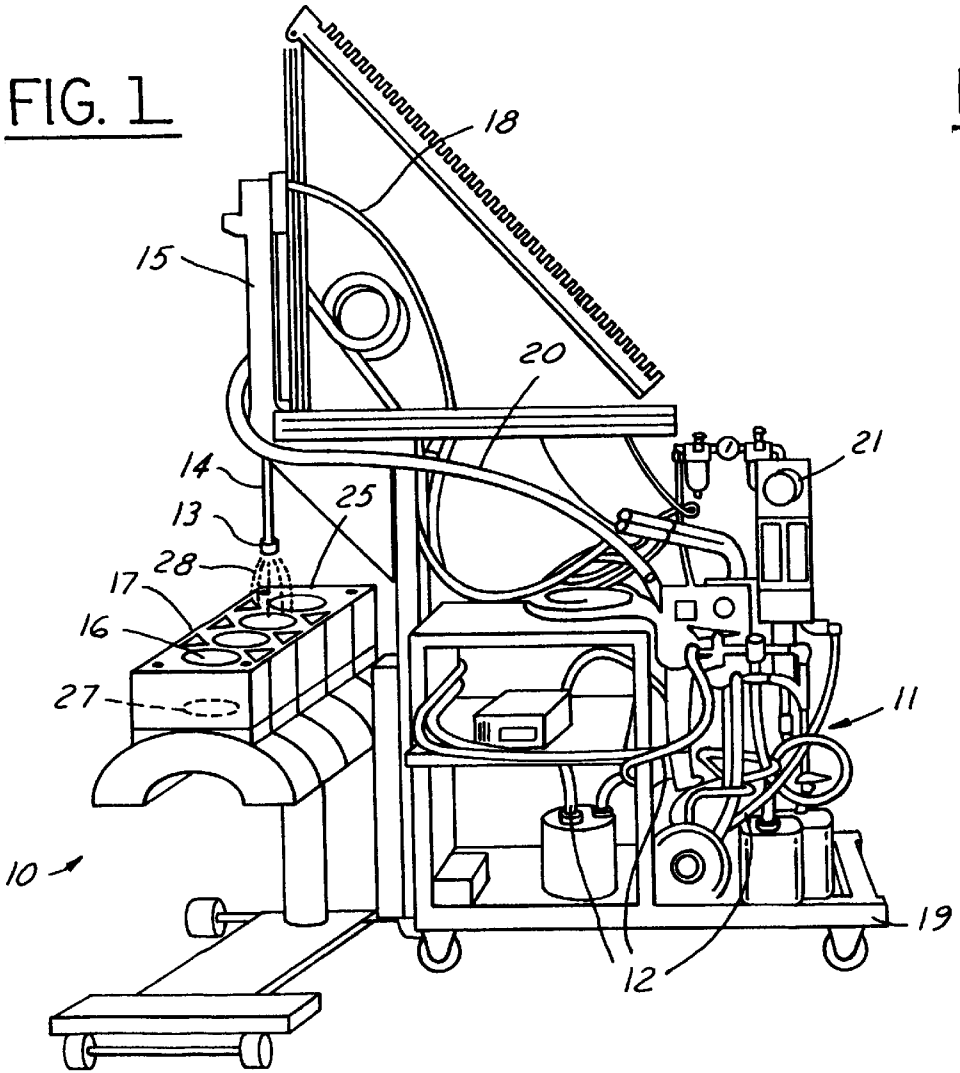
FIG. 1 is a perspective view of an apparatus for carrying out the method of this invention and which is portable for treating engine components individually.

As shown in FIG. 1, a machine 10 for carrying out the method steps of this invention comprises a high pressure emulsion supply circuit 11 having lines 12 that feed a unique nozzle 13 which promotes a hollow conical spray pattern 28. The nozzle 13 is supported on the end of a narrow tubular sheath 14 (about 10 mm in diameter) extending downwardly from a pneumatically operated piston and cylinder device 15 which can be positioned over a selected cylinder bore 16 of an automotive engine block 17 by a boom support 18 carried on a movable cart 19. The device 15 is operated by pneumatic circuits 20 which are controlled by computerized control 21 to effect a uniform desired movement speed of the nozzle 13.

As shown in FIG. 2, the spray pattern 28 emitted from the carbide constituted nozzle 13 is in the form of a hollow cone having a diameter 22, at its effective base, of about 11 inches (approximately 280 mm) and a height 23 (measured from its apex 24) of about 10 inches; the selected cylinder bore 16 (FIG. 1) typically will have a diameter of about 3 inches (90 mm.); however, the bore diameter can range from 50–250 mm and the corresponding nozzle spray 28 will require a cone diameter of 80–400 mm which the nozzle will provide. It is advantageous to activate the spray pattern 28 when the nozzle 13 is somewhat below the cylinder bore bottom 27 (crank end) with its supporting tubular sheath 14 extending concentrically upwardly through the bore 16. After the spray is started the nozzle 13 is raised rapidly and withdrawn from the bore top 25. Working the spray pattern in this manner, from bottom to top, simplifies masking of areas of the block where solid film lubricant is not desired.

The tubular sheath 14 houses a long injection needle valve 26 whose seat 29 is just upstream of the nozzle; the valve admits fluid emulsion to the nozzle.

Figure 3:
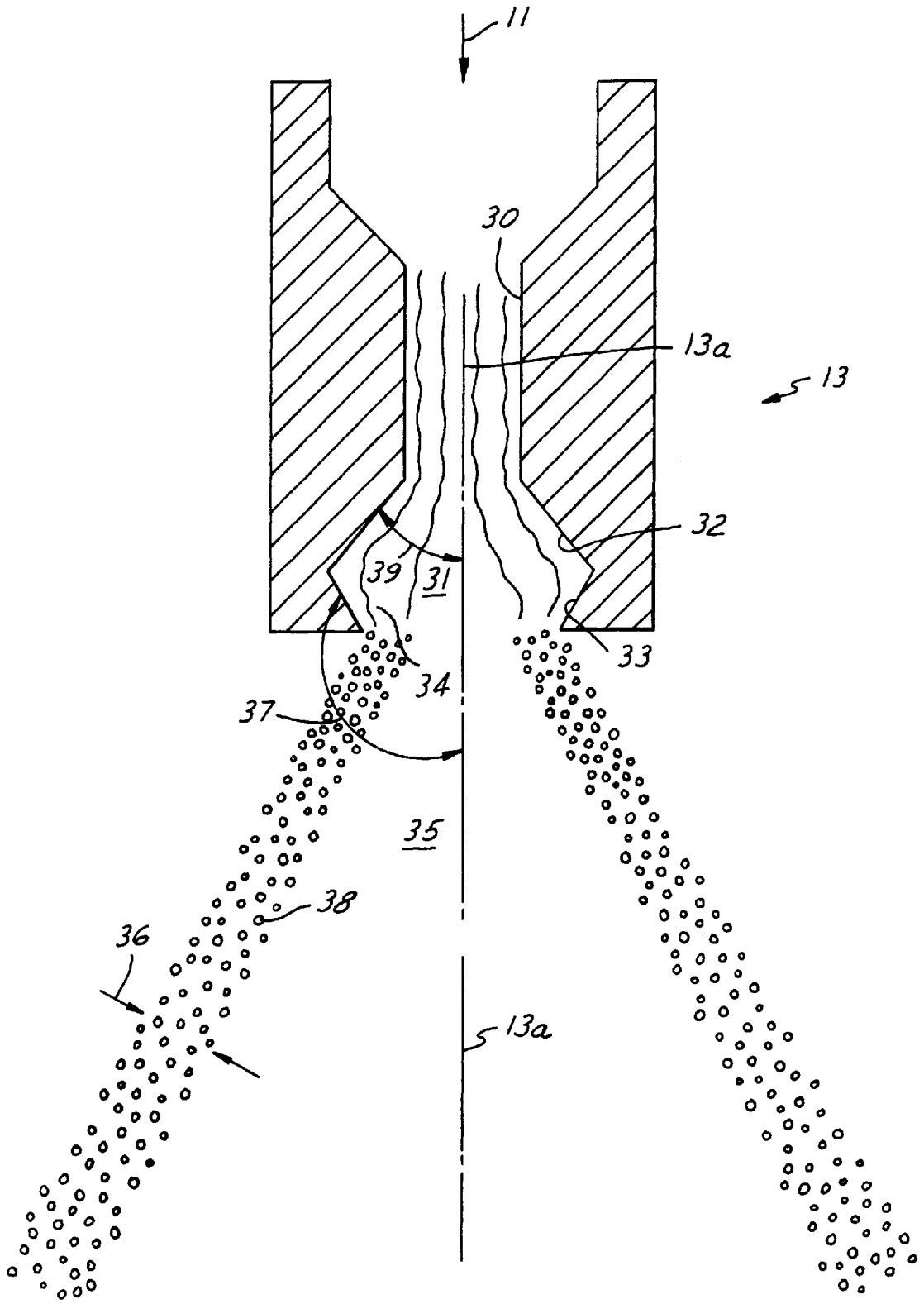
FIG. 3 is a greatly enlarged central sectional view of the nozzle of FIG. 2 showing how the hollow spray pattern is created.

In order to obtain the desired hollow spray pattern, the nozzle 13 (as shown in FIG. 3) is constructed to receive and operate with a high-pressure emulsion supply 11 that has a pressure in the range of 1200–2200 psi. The emulsion passes into the nozzle and enters a straight cylindrical throat 30 that opens into a diverging zone 31 defined by a diverging conical surface 32 which is terminated by a short converging conical surface section 33 that causes the momentum of the fluid 34 to hug the nozzle surface 33 and create a spray pattern 28 having a hollow zone 35. The pattern consists of a shroud of fine mist-like droplets 38 (size range of 0.5–50 micro meters), the shroud having thickness 36 in the range of 2–25 cm. The desired angle 39 (measured from the axis 13*a* of the nozzle) for the diverging surface 32 is about 30–45° and the desired angle 37 of the converging surface section 33 is about 140–155° (±10–15°). The high pressure (1200–2200 psi) of the supply creates the fine mist droplets or particles 38; the extremely high energy forces the fluid to assume the physically smallest droplets to dissipate the applied energy and create tiny spheres which produce correspondingly higher surface area for the fluid. Even higher pressures than 2200 psi could be used, but at a prohibitive cost.

Figure 4:
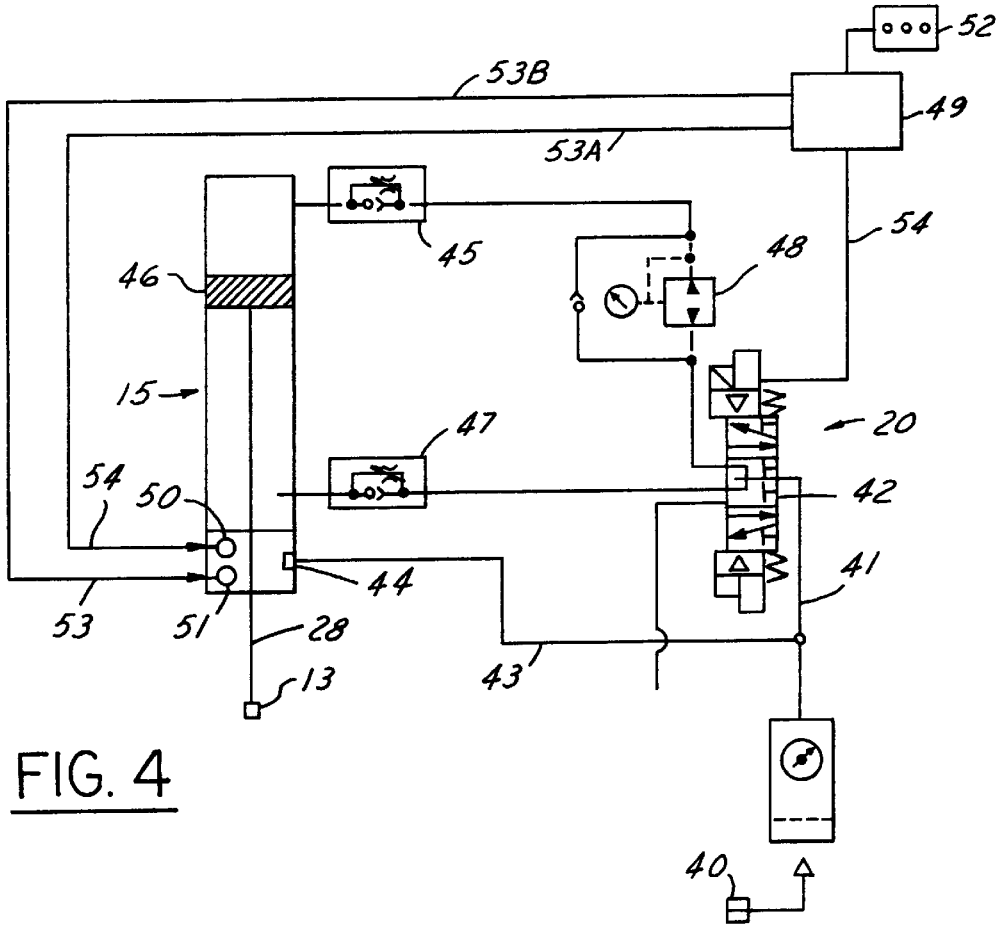
FIG. 4 is a schematic diagram of the pneumatic controls used to operate the piston and cylinder device for moving the nozzle and thereby physically position the nozzle.

The piston and cylinder device 15 mounted on the vertical truss support 18 is operated by pneumatic circuit 20 (shown schematically in FIG. 4). The system elements of the circuit, being carried on cart 19, comprise an air supply 40 (at about 120 psi maximum) connected by line 41 to a main control valve 42 and by line 43 to a brake release valve 44 in device 15. The control valve 42 is shiftable to circulate air fluid pressure to flow control valve 45 for an upstroke of the piston 46 or to circulate air flow pressure to flow control valve 47 for a downstroke of the piston 46. Balance between the stroke flow control valves 45 and 47 is maintained by regulator 48. The main control valve 42 is operated by a computerized controller 49 connected, respectively, by electronic cables (54, 53A, 53B) to the main control valve 42, sensor 50, and brake release valve 51. A portable hand-held control 52 may be used to trigger primary controller 49 but, in a higher volume production environment, this may be replaced by an automatic feedback control loop programmed to perform this function. The hand-held controller allows the nozzle 13 to be incrementally moved into an exact starting position and thence triggered to begin a smooth continuous upstroke or downstroke motion which runs to completion at a designated stop position. During the upstroke or downstroke, the hand-held controller will also trigger the fluid supply circuit to actuate feeding of solid lubricant emulsion to the nozzle.

Figure 5:
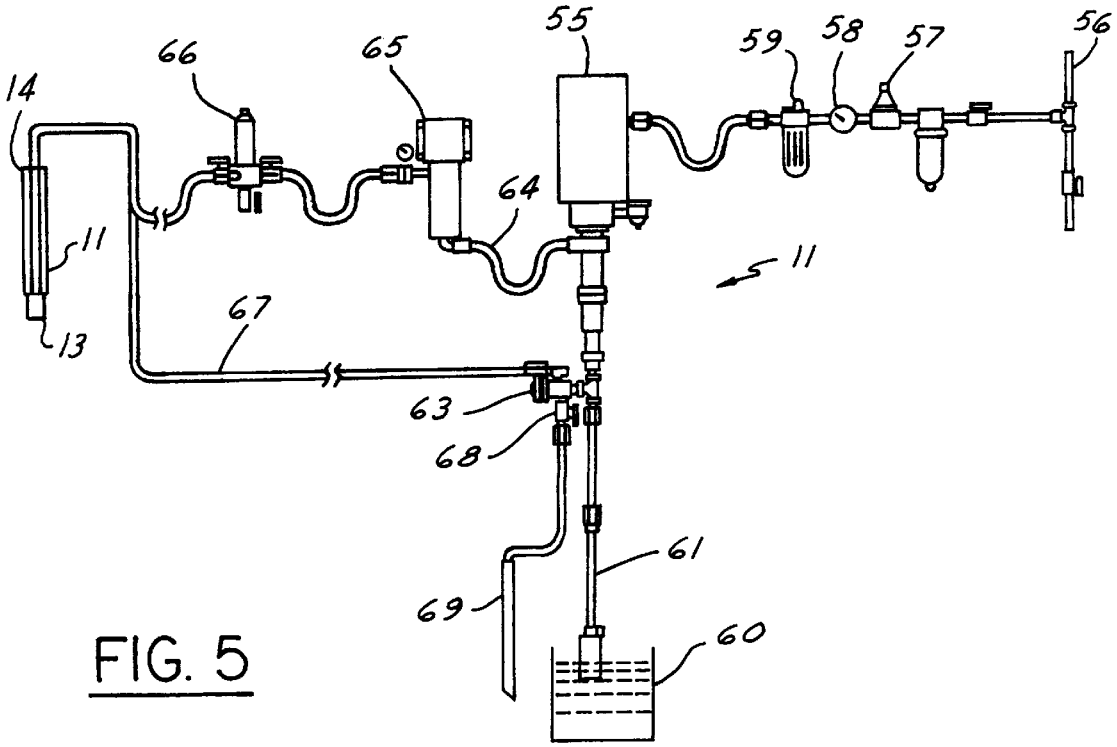
FIG. 5 is a schematic diagram of the hydraulic circuits used for conveying the emulsion to the nozzle.

As shown in FIG. 5, the emulsion supply circuit 11 is comprised of a high pressure pump 55 receiving air from a supply 56, which is regulated at 57, gauged at 58 and lubricated at 59. The pump draws the solid lubricant emulsion from a reservoir 60 through a siphon rod and strainer 61. The emulsion is carried by line 62 through a circulating valve 63 (if open) and thence to pump 55 and onward through line 64, which contains a heater 65 to heat the emulsion to a temperature desirably in the range of 40–80° C. to maintain constant viscosity and therefore a uniform consistent spray pattern. The heated emulsion is filtered at 66 and thence delivered to the needle valve controlled tubular sheath 14 leading to the nozzle 13. If the needle valve (circulatory valve) is not open, the emulsion is recirculated through line 67 back to the circulating valve 63. If the circulating valve is closed, the emulsion is drained through valve 68 and out through line 69.

It is necessary to maintain the viscosity of the fluid emulsion in a narrow range, such as 11–13 Brookfield Viscosimeter (and/or 80–102 centistrokes) for an emulsion containing $MoS_2$ BN, and graphite in a thermo plastic or thermoset resin mixture. This is accomplished by adding solvent or the raw emulsion stock to the reservoir containing the spray batch to achieve the desired viscosity in the reservoir 60. To increase the chemical adhesion of the fine mist spray, it is desirable to heat the cylinder bore surface to a temperature of about 100° C.; this promotes faster drying of the deposited emulsion without "runs". "Runs" seriously affect the piston-bore clearance and should be avoided.

The method of this invention which can be carried out by use of the above-described apparatus and materials and comprises the steps of (a) preparing the cylinder bore surface to expose fresh metal free of contamination, (b) generating a hollow conical spray consisting of fine mist droplets of a solid lubricant emulsion, the conical spray having an effective base with a diameter greater than the diameter of the cylinder bore, and (c) moving the apex of the conical spray along the axis of the bore at a uniform speed to deposit a coating of the emulsion on the interior of such cylinder bore in a thickness desirably 5–15 microns, but no greater than 30 microns.

Preferably, the cylinder bore surface is prepared in step (a) by first degreasing, using a biodegradable solvent which leaves no film, and thence is wiped using acetone or alcohol. Secondly, the bore is etched with a 5% nital solution, if the substrate is steel or cast iron; or with a 25% hydrofluoric acid solution if the substrate is aluminum, the first etching may be followed by a second etching with a 50% nitric acid water solution. The etchings are neutralized with alcohol with a nital solution or warm water if hydrofluoric acid and nitric acid is utilized. Lastly, the cylinder bore surface is heated in an air circulating oven to about 100° C. for a minimum of one hour to ensure evaporation and removal of all water from the surface to be coated.

As soon as possible after completion of step (a), steps (b) and (c) are carried out concurrently, ensuring that a heated fine mist of solid lubricant emulsion particles is laid down uniformly from a hollow conical spray at a traverse speed of about 0.2–1.5 m/second to achieve a thickness of 8–12 microns. Faster speeds yield a thinner coating; however to ensure uniform surface coverage, much higher pressure needs to be applied.

While the invention has been shown and described in its preferred embodiments, it will be clear to those skilled in the arts to which it pertains that many changes and modifications may be made thereto without departing from the scope of the invention.

What is claimed is:

1. A method of coating honed cylinder bore surfaces with an ultra thin lubricant phase, the cylinder bore being generated by a tool revolved about an axis of revlution, comprising:

(a) preparing the cylinder bore surface to expose fresh metal free of contamination, (b) generating a hollow conical spray consisting of fine mist droplets from an emulsion containing a solid lubricant, the conical spray being generated using a high pressure supply of said emulsion in the pressure range of 1200–2200 psi and, using a nozzle having diverging and converging sections effective to cause the momentum of the emulsion to hug the periphery of the nozzle interior thereby effecting a hollow interior to the conical spray, the conical spray having a base with a diameter greater than the diameter of said cylinder bore, and (c) moving the apex of the conical spray along the axis of the cylinder bore at a uniform speed to deposit a coating of said emulsion on the interior of said cylinder bore in a thickness range of 5–15 microns.

2. The method as in claim 1 in which in step (a) the preparation is carried out by first etching the cylinder bore surface followed by rinsing and neutralization and then by heating the cylinder bore nurface to a temperature of about 100° C.

3. The method as in claim 1 in which in step (b) the solid lubricant emulsion for creating said conical spray has a viscosity in the range of 11–13 Brookfield Viscosirmeter or 80–102 centistrokes.

4. The method as in claim 1, in which said emulsion is heated to the temperature of 40–80° C. prior to forming said fine mist droplets.

5. The method as in claim 1, in which said emulsion containing solid lubricants consists of a mixture of molybdenum disulfide, boron nitride, and graphite in a thermoset or thermoplastic polymer resin base.

6. The method as in claim 1, in which step (c) is carried out in a continuous smooth upward stroke of the conical spray at a uniform speed in the range of 0.2–1.5 meters/second (0.5–4.5 feet/sec.).

* * * * *